US006238255B1

(12) United States Patent
Takase

(10) Patent No.: US 6,238,255 B1
(45) Date of Patent: May 29, 2001

(54) MARINE PROPULSION CONTROL

(75) Inventor: Hiroaki Takase, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/395,792

(22) Filed: Sep. 14, 1999

(30) Foreign Application Priority Data

Sep. 14, 1998 (JP) ..... 10-260675

(51) Int. Cl.[7] ..... B63H 21/21

(52) U.S. Cl. ..... 440/1; 440/86; 440/87; 477/99; 477/101

(58) Field of Search ..... 440/1, 84, 86, 440/85, 87; 74/480 B, 473.15; 477/99, 101, 102

(56) References Cited

U.S. PATENT DOCUMENTS 4,439,163 * 3/1984 Burmeister et al. ..... 440/86
4,726,798 * 2/1988 Davis ..... 440/75
4,986,776 * 1/1991 Hensel et al. ..... 440/1
5,050,461 9/1991 Onoue et al. ..... 74/872
5,692,931 * 12/1997 Kawai ..... 440/86
5,910,191 6/1999 Okamoto ..... 74/473.14

* cited by examiner

*Primary Examiner*—Sherman Basinger
(74) *Attorney, Agent, or Firm*—Knobbe, Martens, Olson & Bear LLP

(57) ABSTRACT

An improved shift mechanism for a marine propulsion transmission is provided. The shift mechanism includes a guide that defines a slot that receives a member of a linkage that connects an operator unit with a shift rod. Movement of the shift mechanism is converted into substantially linear motion and a shift position sensor is located at a substantially right angle to that movement. Information from the sensor is transmitted to a control unit and is employed to prevent abrupt starts. The shift position sensor is located on the side of an engine for ease of assembly and maintenance. Movement of the shift mechanism may also cause pivotal movement of the guide and this pivotal movement may be employed to reduce the engine speed and assist shifting.

40 Claims, 12 Drawing Sheets

MARINE PROPULSION CONTROL

BACKGROUND OF THE INVENTION

1. Field of the Invention

The present invention relates to a marine propulsion system and, in particular, to an improved shifting mechanism.

2. Background of the Invention

Some conventional outboards motor include the following basic components: an engine, a crankshaft, a power transmission, a propeller, and a shifting mechanism. The engine may be contained within a protective cowling that includes an upper cover and a lower tray. Extending below the tray is a drive shaft housing that supports the engine and houses the drive shaft. Below the drive shaft housing is a lower unit that carries the transmission and the propeller. The transmission is located inside the lower unit and transmits power from the drive shaft to the propeller. Rotation of a shift rod, which depends into the transmission, shifts the transmission between gears.

The shift rod may be controlled by an operator. For instance, an actuator controlled by the operator may be coupled together with the shift mechanism and a shift lever. The shift lever, in turn, may be coupled to the shift rod such that circular rotation of the shift lever rotates the shift rod. Thus, the watercraft operator uses the actuator and the shift mechanism to selectively determine the gear of the transmission.

Shift mechanisms often include a shift position detection sensor to detect the circular motion of the shift lever. The sensor may be used to determine when the shift lever is in the neutral position. In such instances, the engine may be designed to start only when it receives a signal from the shift position sensor that the shift lever is in a neutral position. This helps to reduce abrupt movement upon ignition start-up. In addition, as disclosed in U.S. Pat. No. 5,050,461, the shift mechanism may also be configured to temporarily reduce the engine speed during shifting. This type of engine control aids shifting between gears.

SUMMARY OF THE INVENTION

Earlier shift mechanisms, however, suffer from several drawbacks. For example, the shift position sensor may be located in a space within the lower tray, between the engine and the drive shaft housing. This space is very narrow, making assembly and maintenance of the shift position detection sensor difficult. Furthermore, the recent trend in the industry is to reduce the size of the outboard motor by compacting the cowling. This exacerbates the cramped space in the lower tray. Therefore, there is a need to reduce the size and complexity of the shift mechanism and to reposition the shift mechanism such that it can be assembled and maintained easier.

In addition, the shift position sensor is preferably positioned at a right-angle relative to the motion of the shift lever in order to detect more accurately the position of the shift lever. However, due to the arcuate paths of many shift levers, properly configuring such a right-angle relationship has proven difficult.

Thus, one object of the present invention is to overcome some or all of the aforementioned limitations of the prior art and to provide an improved shift control mechanism Accordingly, one aspect of the present invention involves a marine propulsion system comprising a transmission with at least two operating states. A shift mechanism is coupled to the transmission and establishes the operating state of the transmission. The shift mechanism moves between at least a first shift position and a second shift position with the first shift position corresponding to the first operating state of the transmission and the second shift position corresponding to the second operating state of the transmission. An operator unit is disposed remotely relative to the shift mechanism and is adapted to move between at least a first and second control position. The operator unit is coupled to the shift mechanism such that movement of the operator unit to the first control position positions the shift mechanism in the first shift position, and movement of the operator unit to the second control position positions the shift mechanism in the second shift position. The shift mechanism includes a member that moves along a substantially linear path. A shift position sensor is arranged to cooperate with the member so as to detect at least one of the shift positions.

Another aspect of the present invention involves a marine propulsion system comprising an engine and a transmission that is coupled to the engine and has at least two operating states. A shift mechanism is coupled to the transmission and establishes the operating state of the transmission. The shift mechanism is capable of moving between at least a first shift position and a second shift position with the first shift position corresponding to the first operating state of the transmission and the second shift position corresponding to the second operating state of the transmission. An operator unit is disposed remotely relative to the shift mechanism. The operator unit is adapted to move between at least first and second control positions and is coupled to the shift mechanism. Movement of the operator unit to the first control position positions the shift mechanism in the first shift position, and movement of the operator unit to the second control position positions the shift mechanism in the second shift position. A shift position sensor is arranged to detect at least one of the shift positions. The sensor is arranged on a side of the engine and to an outer side of the shift mechanism.

For purposes of summarizing the invention and the advantages achieved over the prior art, certain features, aspects, objects and advantages of the invention have been described above. Of course, none of these features, aspects, objects or advantages should be considered essential. Also, any one embodiment of the present invention may employ one or more of these features, aspects, objects or advantages. Thus, for example, those of ordinary skill in the art will recognize that the invention may be embodied or carried out in a manner that achieves or optimizes one advantage or group of advantages as taught herein without necessarily achieving other features, aspects, objects or advantages, as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and some of its features, aspects, objects, and advantages, certain preferred embodiments and modifications thereof will become apparent to those skilled in the art from the detailed description herein having reference to the figures that follow, of which.

DETAILED DESCRIPTION OF THE PREFERRED EMBODIMENT

Figure 1:
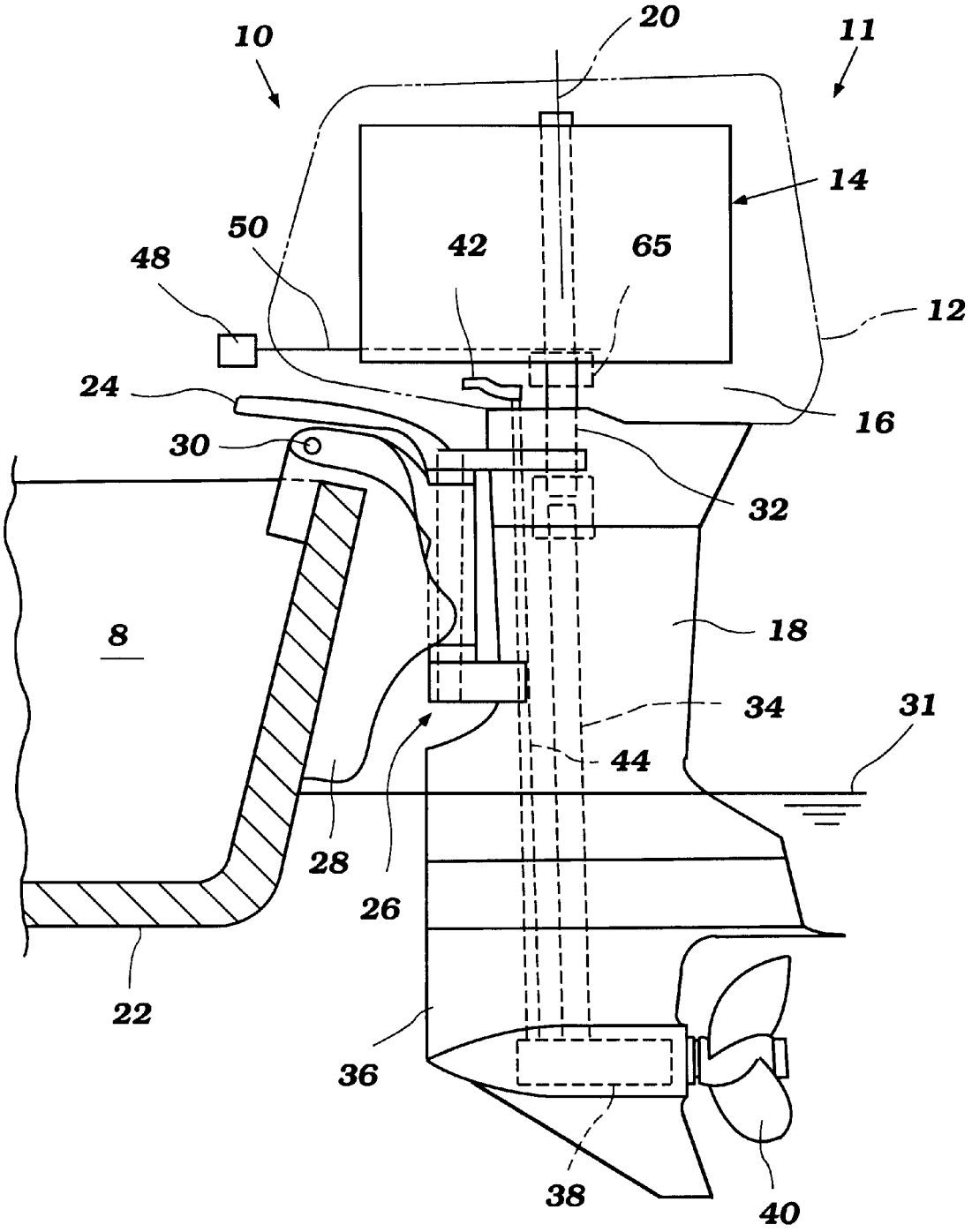
FIG. 1 is a side elevation view of an outboard motor constructed in accordance with an embodiment of the invention.

FIG. 1 depicts an outboard motor 10 constructed in accordance with certain features, aspects, and advantages of the present invention. While the present invention is described in conjunction with an outboard motor, those of ordinary skill in the art will appreciate that the invention may be used in other applications.

The outboard motor 10 has a powerhead 11 which includes an internal combustion engine 14. A protective cowling 12 surrounds the engine 14. The cowling 12 includes a lower tray 16. The tray 16 and the cowling 12 together define a compartment which houses the engine 14 with the lower tray 16 encircling a lower part of the engine 14.

The motor 10 is moveably mounted to a hull 22 of the watercraft 8. Preferably, a steering shaft 24 is connected to the motor 10. The steering shaft 24 is supported for steering movement about a vertically extending axis (not shown) within a swivel bracket 26. This mounting permits the watercraft to be steered by turning the motor 10 about the vertically extending axis that passes through the swivel bracket 26.

The swivel bracket 26 is connected to a clamping bracket 28. The clamping bracket enables movement of the motor 10 about a generally horizontally extending pin 30. The clamping bracket 28 is connected to the hull 22 of the watercraft. The mounting about the pin 30 permits the motor 10 to be trimmed or tilted up and down with respect to the water 31 in a vertical plane about a horizontal axis extending through the pin 30.

As is typical with outboard motor practice, the engine 14 is supported so that its output shaft 32 (e.g., crankshaft) rotates about a generally vertical axis 20. The crankshaft 32 drives a drive shaft 34 which depends from the powerhead 11 and also rotates about the generally vertical axis 20. The driveshaft 34 extends through a drive shaft housing 18 and is suitably journalled therein for rotating about the vertical axis 20. As seen in FIG. 1, the drive shaft housing extends from the lower tray 22 and terminates in a lower unit 36.

The drive shaft 34 continues into the lower unit 36 where it drives a transmission 38 through an input gear (not shown). The transmission 38 selectively couples the drive shaft 34 to a propulsion shaft (not shown). The propulsion shaft is coupled to the propeller 40. The transmission 38 advantageously is a forward/neutral/reverse-type transmission. In this manner, the drive shaft 34 drives the propulsion shaft in any of these operational states as described below.

The operational details of the transmission 38 are not essential to the present invention. Typically, in marine propulsion systems, "dog-clutch" type transmissions are used which allow the outboard motor 10 to operate in forward, neutral, and reverse drive. This type of transmission is well known in the art and thus the details are not illustrated but the main components of the transmission are described.

Within the transmission 38 is a bevel gear affixed to the lower end of the drive shaft 34. The bevel gear meshes with a pair of counter rotating driven gears which are journalled in a suitable manner for rotation on the propeller shaft. The propeller shaft is, in turn, journalled in a suitable manner in the lower unit 36. A dog-clutching sleeve has a splined connection to the propeller shaft located between the bevel gears and is axially moveable. If the dog-clutching sleeve is positioned so that the dog-clutching teeth are out of engagement with the teeth of the bevel gears, the transmission is in neutral. When the dog clutch sleeve is shifted forward along the axis of the propeller shaft, the dog clutching teeth are engaged with one of the bevel gears and the propeller shaft is driven in one direction. Alternatively, when the dog clutching sleeve is shifted backwards along the axis of the propeller shaft, it engages the other bevel gear and the propeller shaft is driven in an opposite direction.

The dog clutching sleeve is reciprocated by a shift mechanism 46 (FIG. 2) that includes a shift control lever 42 (FIG. 1 and FIG. 2) that is affixed to a shift control rod 44 (FIG. 1). As will be described in detail later, the shift mechanism 46 rotates the control lever 42 and therefore rotates the shift control rod 44. The shift control rod 44 depends into the transmission 38. Within the transmission 38, by means well known in the art, rotation of the shift control rod 44 causes reciprocating movement of the dog clutch sleeve. Accordingly, rotation of the control lever 42 shifts the transmission between forward, neutral and reverse positions.

With reference to FIGS. 2–6, the shift mechanism 46 will be described in detail. The shift mechanism 46 cooperates with a remotely located operator unit 48 that controls the shifting mechanism 46. In an exemplifying embodiment, the operator unit 48 is located on the steering shaft 24 (FIG. 1) of the outboard motor 10; however, the operator unit 48 may also lie either in the hull 22 of the watercraft or within or adjacent to the power head 11 of the outboard motor 10.

A Bowden-wire-type shift cable 50 desirably couples the operator unit 48 to the shifting mechanism 46. In the illustrated embodiment, the cable 50 has an outer casing 52. A bracket (not shown), which is mounted within the cowling 12, supports a portion of the cable 50 near the shift control mechanism 46 and prevents movement of the outer casing 52 of the cable 50 relative to the cowling 12.

The illustrated shifting mechanism 46 includes a fitting 54 positioned at the end of the shift cable 50. The fitting 54 is coupled to an end of a link 56. A pivot pin 58 of the shift control mechanism 46 interconnects the cable fitting 54 and the link 56 in order to permit relative rotational movement between these components.

Figure 3:
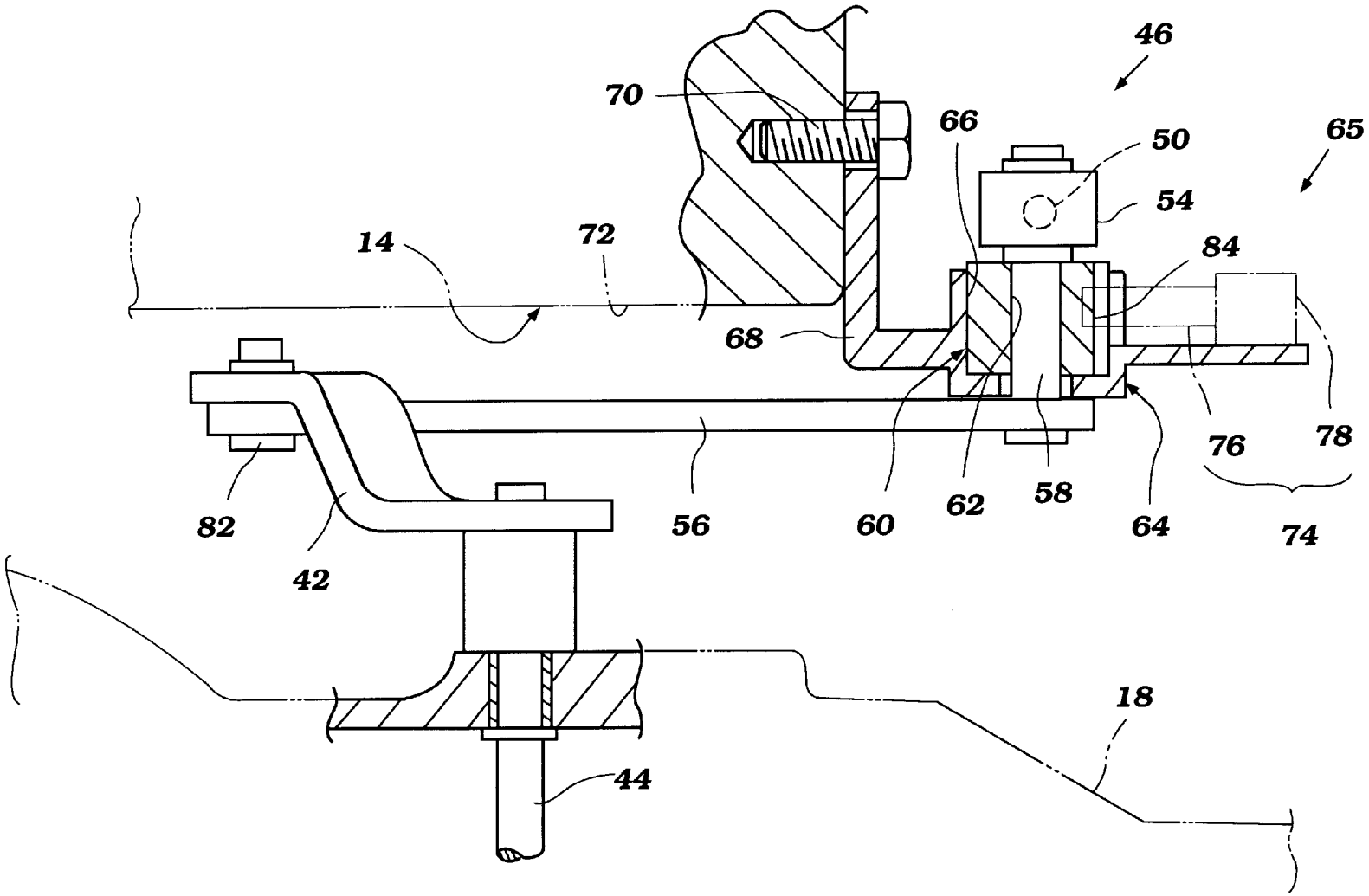
FIG. 3 is a partially sectioned side elevation view of the shifting mechanism shown in FIG. 2 taken along line 3—3.

A slider 60 supports the pivot pin 58 within an elongated aperture 62. A guide 64 supports the slider 60. As best seen in FIG. 3, the guide 64 includes a slot or cam groove 66. Preferably, the slot 66 defines a substantially linear path, in which the slider 60 translates. A bracket 68 supports the guide 64 and is attached by a bolt 70 to the crankcase 72 of the engine 14.

Figure 2:
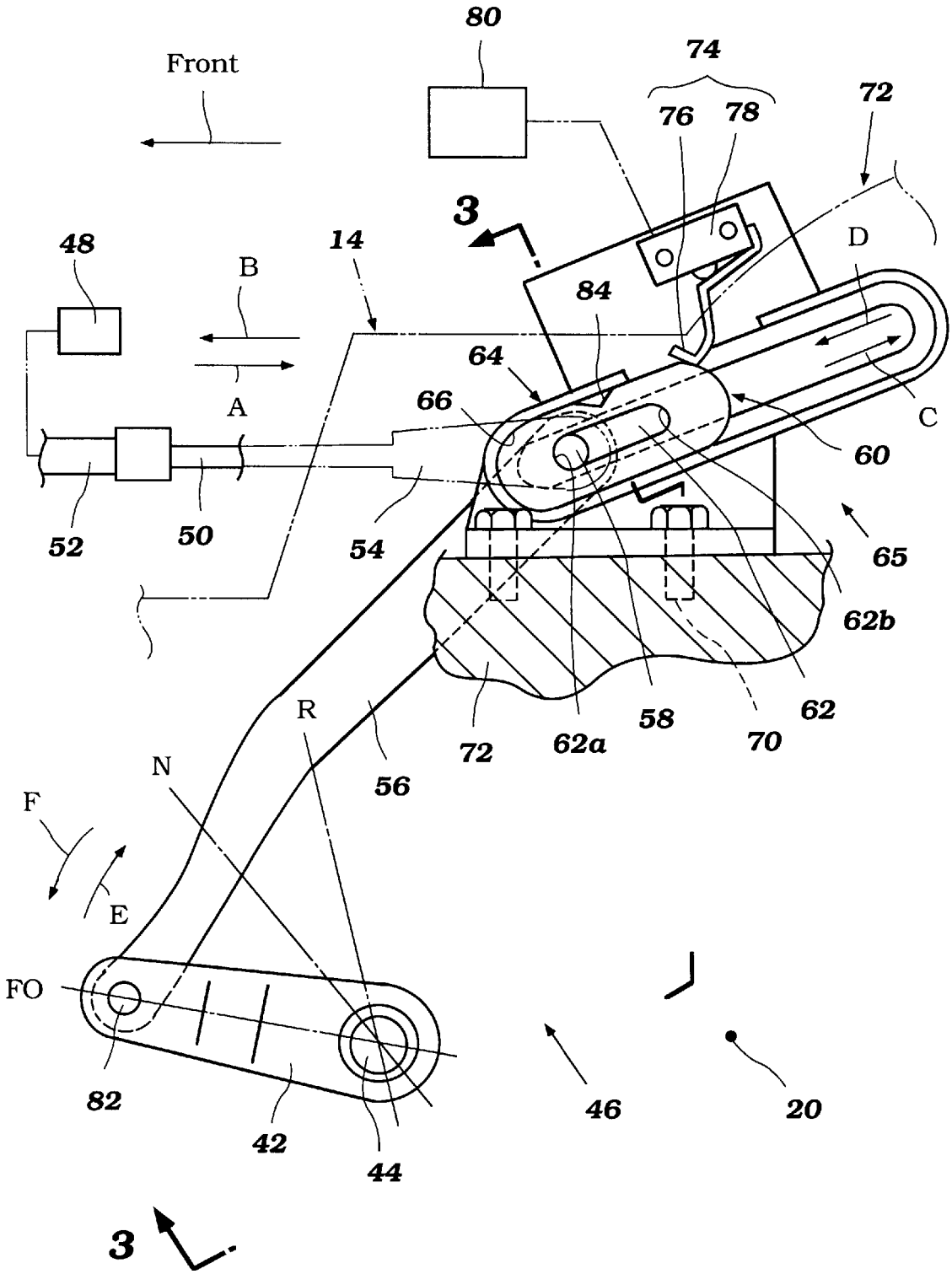
FIG. 2 is a partially sectioned top plan view showing a shifting mechanism configured with certain features, aspects, and advantages of the present invention.

As shown in FIG. 2, a shift position sensor 74 is located along a side of the guide 64. Moreover, the shift position sensor has a portion that is preferably positioned at a substantially right-angle relative to the substantially linear path of the slider 60. The shift position sensor 74 is generally comprised of a detection lever 76 and a sensor body 78. During operation of the outboard motor, the shift position sensor 74 transmits a signal to a control unit 80. The function and purpose of the shift position sensor 46 will be described later. The guide 64, slider 60 and sensor 74 together comprise a guide mechanism 65.

An opposite end of the link 56 is connected to an end of the shift control lever 42. A pivot pin 82 couples together the ends of the link 56 and the lever 42 to allow relative rotational movement between these components of the shifting mechanism 46.

As best seen in FIG. 3, the shift lever 42 has a vertical jog. A portion of the lever 42 thus lies below the end coupled to the link 56. The shift control rod 44 is fixed to the lower portion of the shift lever 42. As understood from FIG. 1, the shift control rod 44 depends from the power head 16 to the transmission 38. The shift control rod 44 operates the transmission 38 to change the drive condition of the transmission 38 as described above.

Figure 6:
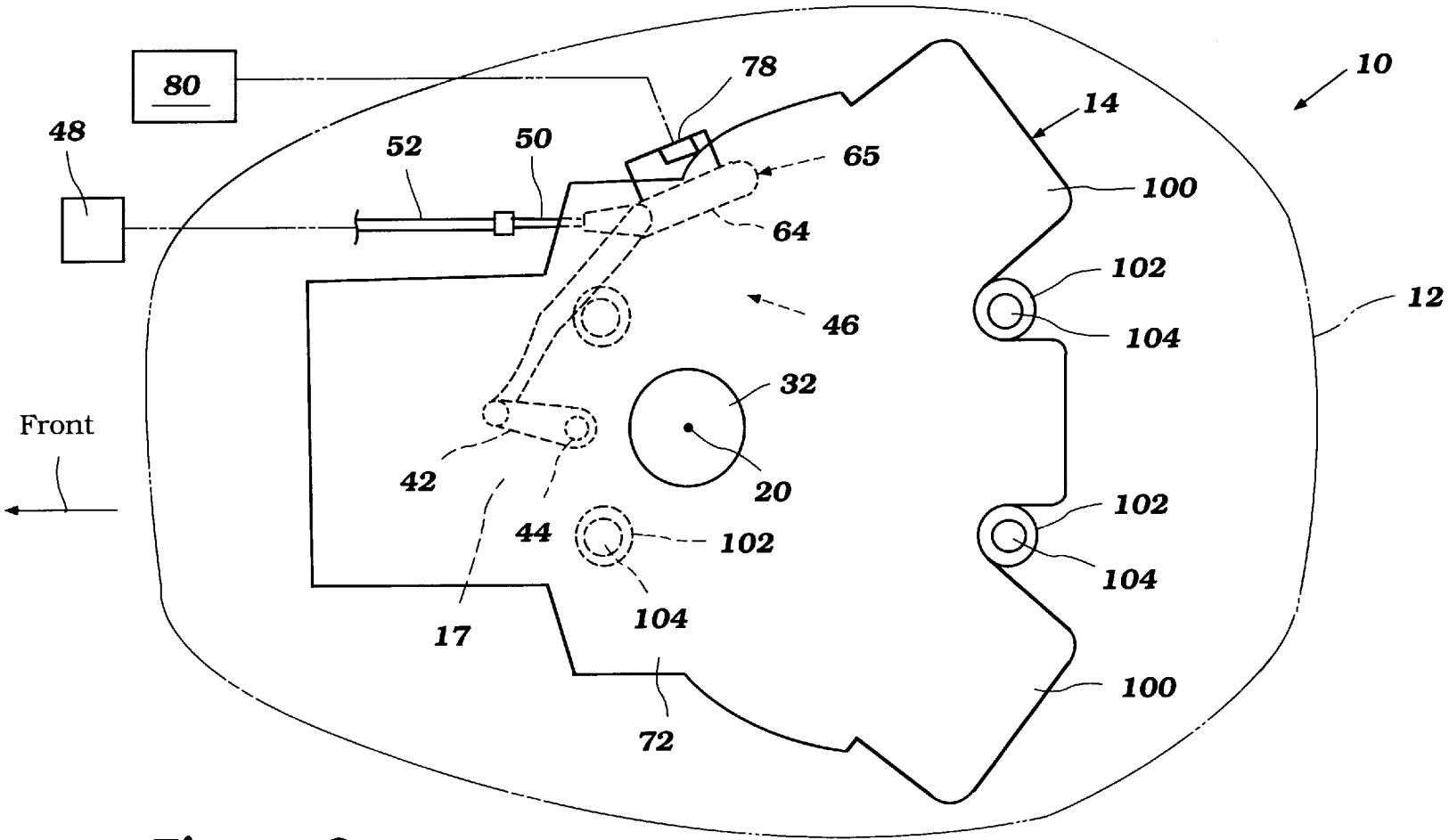
FIG. 6 is a schematic top view of the engine and the shifting mechanism shown in FIG. 2, with a cowling outline shown in phantom lines.

As best understood from FIGS. 3 and 6, parts of the shift mechanism 46, such as the link 56 and the control lever, 42 are preferably arranged and operate vertically below the crankcase 72 within a space 17 between the engine 14 and the drive shaft housing 18. The guide mechanism, however, 65 is preferably arranged on a side of the engine 14 and crank case 72. More preferably, the guide mechanism 65 is located in a space between the engine 14 and the cowling 12. Moreover, as is best shown in FIG. 6, the shift position sensor 74 is preferably arranged on the outer side of the shift mechanism relative the engine 14. More preferably, the guide 64 and slider 60 are interposed between the sensor 74 and the engine 14. As such, the shift mechanism 46 produces a compact arrangement within the space 17 between the lower tray 16 and the cowling 12. This location also protects the link 56 and the control lever 42, shift rod 44 and position sensor 74 while still allowing access for assembly and repairs.

The operation of the shift control mechanism will now be described in detail. With reference to FIG. 2, the cable 50 is interlocked with the operator unit 48. The shift lever 42 is in the forward position "FO". The slider 60 is located at one end of the guide 64. The pivot pin 58 is located at one end 62*a* of the elongated aperture 62. In this position, the detection lever 76 of the shift position sensor 74 physically engages the slider 60. Thus, the slider 60 is secured in this position. At this position, the sensor 76 prohibits the engine from starting by transmitting a signal to the control unit 80. Accordingly, the sensor 76 prevents the watercraft from abruptly moving forward when started.

As the cable 50 begins to move in a direction "A", the pivot pin 58 slides from one end 62*a* of the aperture toward the other end 62*b*, but the slider 60 remains still and does not slide in the "C" direction. In such a manner, play is provided in the shift mechanism 46 and the slider 60 remains still despite small movements of the cable 50. Thus, the shift mechanism 46 includes a lost motion coupling. Preferably, this lost motion coupling is interposed between the operator unit and the shift lever. More preferably, the lost motion coupling is interposed between the operator unit 48 and the sensor 74. Furthermore, the direction of the lost motion is preferably in the same direction as the motion of the slider.

Figure 4:
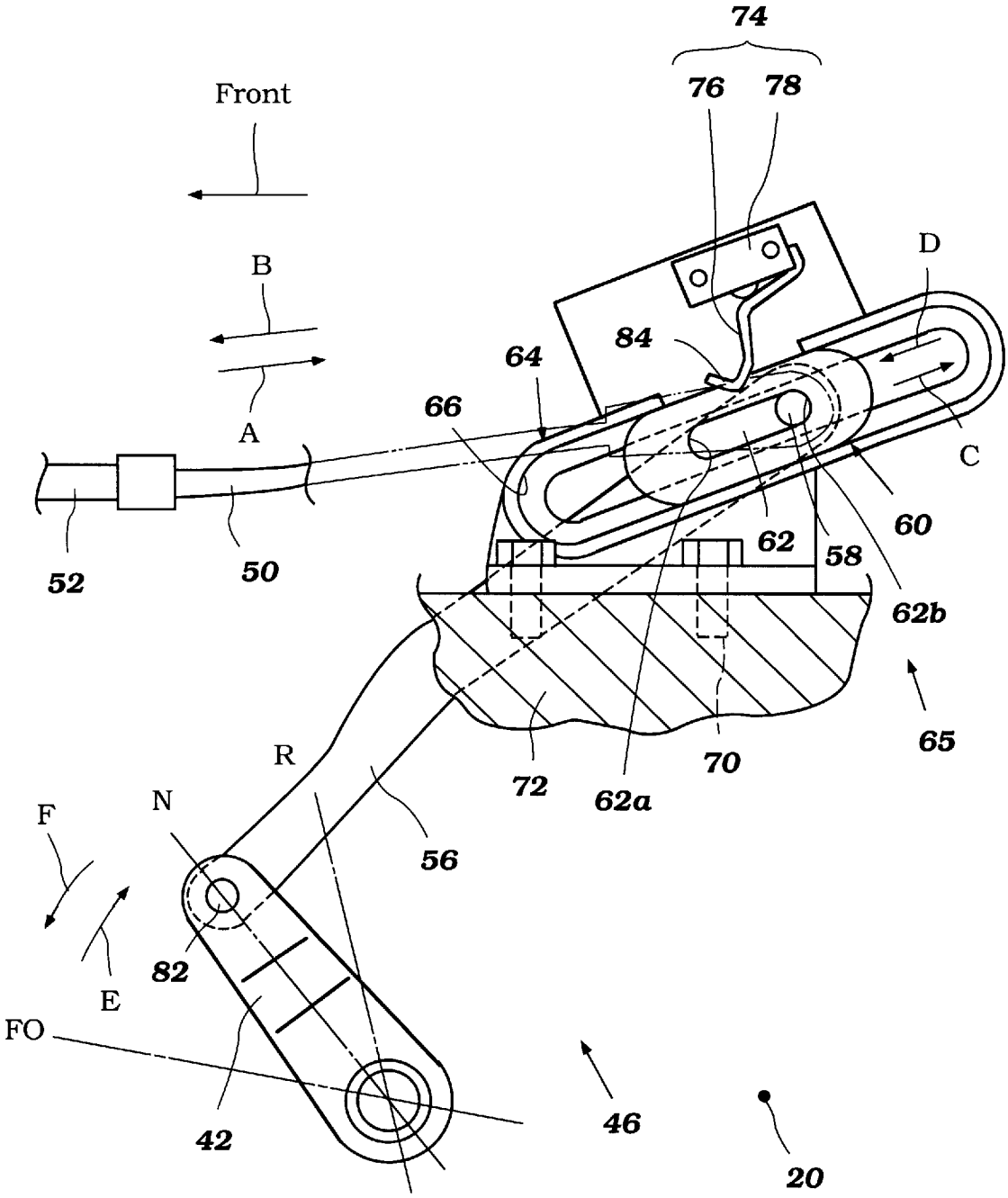
FIG. 4 is a partially sectioned top plan view of the shifting mechanism shown in FIG. 2, with portions removed, and showing the mechanism in a neutral drive position.

When the cable 50 moves further in the "A" direction, the pivot pin 58 eventually reaches the other end 62*b* of the aperture 62, and the slider 60 moves in the "C" direction. As shown in FIG. 4, when the cable 50 moves in the "A" direction for a certain distance, the shift lever 52 rotates to a neutral position "N" through the link 56 and pivot pin 82 as described above. The transmission 38 then shifts to the neutral position, and the engine 14 ceases power transmission to the propeller 40.

When the shift lever 52 is positioned in the neutral position "N", the detection lever 76 of the sensor 74 is physically engaged with an etched or recessed portion 84 of the slider 60. Because of this engagement, the slider 60 is secured in this position. While in this position, the sensor 74 transmits a signal to the control unit 80 that allows the engine 14 to start.

Figure 5:
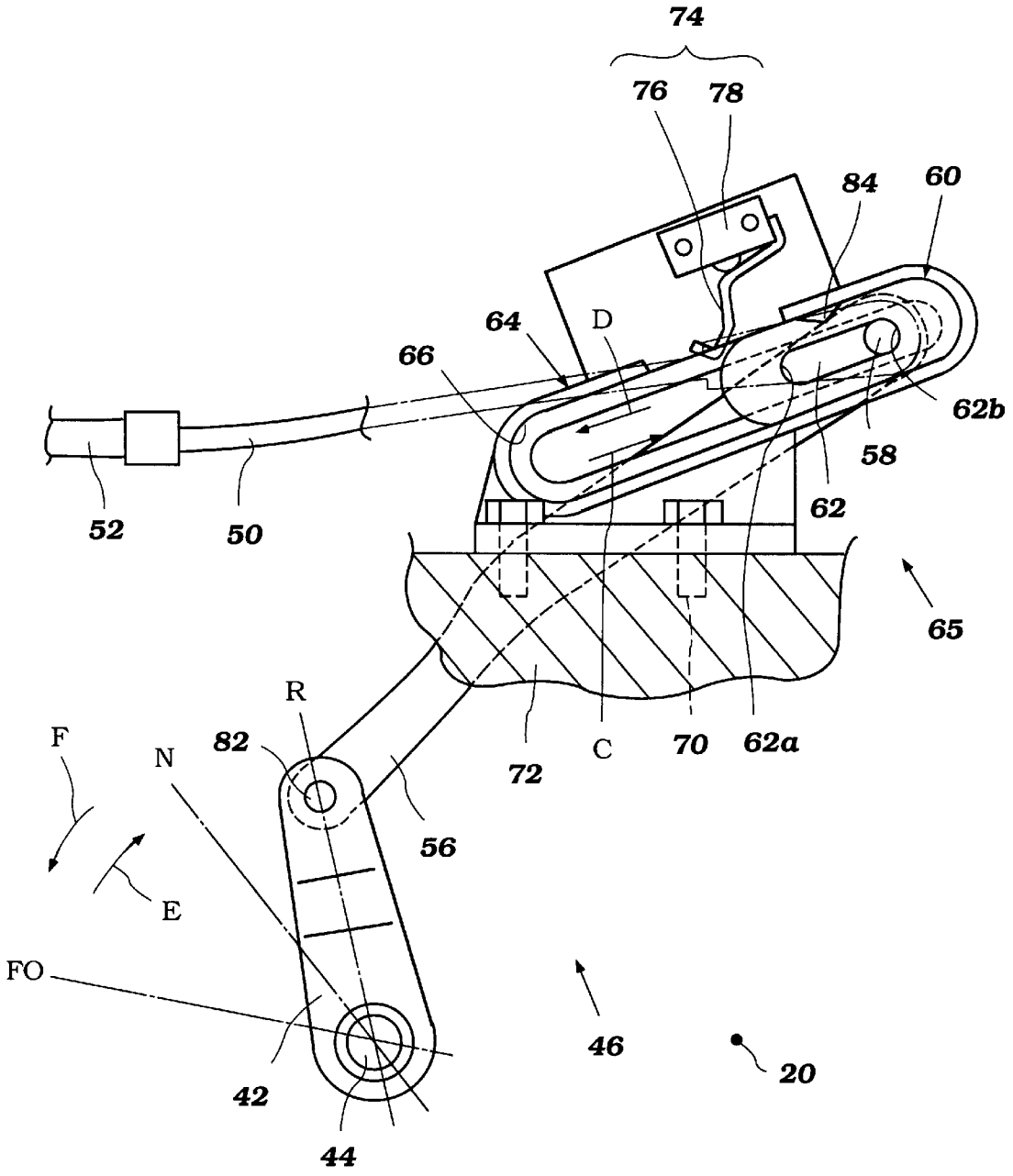
FIG. 5 is a partially sectioned top plan view of the shifting mechanism shown in FIG. 2, with portions removed, and showing the mechanism in a reverse drive position.

As the cable 50 further slides in the "A" direction, the shift lever 42 interlocks with the movement of the cable 50 as described above and pivots to a reverse position "R" (See FIG. 5). Accordingly, the transmission 38 shifts into reverse gear allowing the watercraft to move in a reverse direction.

In the position depicted in FIG. 5, the slider 60 is located at the end of the guide 64 in the "C" direction. Although the detection lever 76 is disengaged from the recessed portion 84 of the slider 60, the detection lever 76 is still in physical contact with the slider 60. Therefore, the slider 60 is secured in its position at the end of the guide 64. In this position, the sensor 74 transmits a signal to the control unit 80 that prevents the engine 14 from starting.

The shift lever 42 returns in order from the reverse position "R" to the neutral position "N" and forward position "FO" when the cable 50 slides in the "B" direction and the slider 60 correspondingly slides in the "D" direction to return to its original position as illustrated in FIGS. 2, 5 and 6. Because the slider 60 slides in a linear direction, the sensor 74 can be positioned at a substantially right angle to the slider 60 and be more securely and accurately arranged as compared to prior art. Advantageously, the illustrated sensor can transmit a signal to prevent ignition or allow ignition with only two positions due to component positioning and gearing. It is envisioned, however, that other arrangements are also possible.

Another arrangement having certain features, aspects, and advantages in accordance with the present invention is depicted FIGS. 7–10. The illustrated arrangement is similar to that described above and similar parts have been given the same reference numbers. The following description will focus on the additional features, which are not present in the above described arrangement.

In addition to the shift mechanism 46 described above, there is further provided a pivot detection sensor 86, which cooperates with the shift mechanism 46 so as to provide a signal when the transmission 38 is being shifted from either the forward drive position or the reverse drive position . This sensor forms a portion of a mechanism that will operate to slow the speed of the engine 14 and make disengagement of the dog clutching teeth easier. As with the first arrangement, this shift mechanism 46 includes a guide mechanism 65 that includes a guide 64 which defines a slot or cam groove 66 in which a pivot pin 58 and a slider 60 are journalled.

Figure 7:
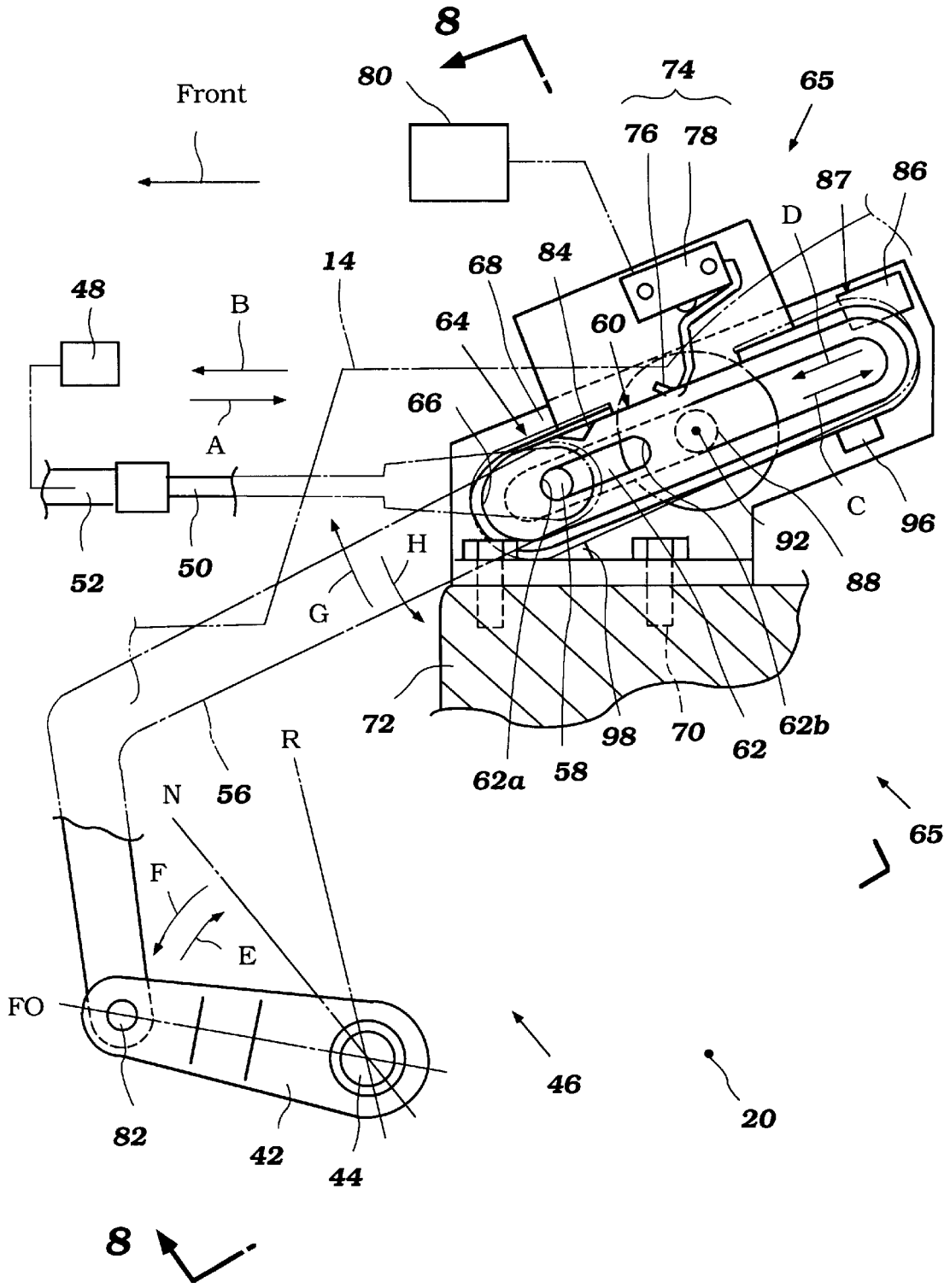
FIG. 7 is a partially sectioned top plan view showing another shifting mechanism, configured in accordance with certain features aspects and advantages of the present invention.
Figure 8:
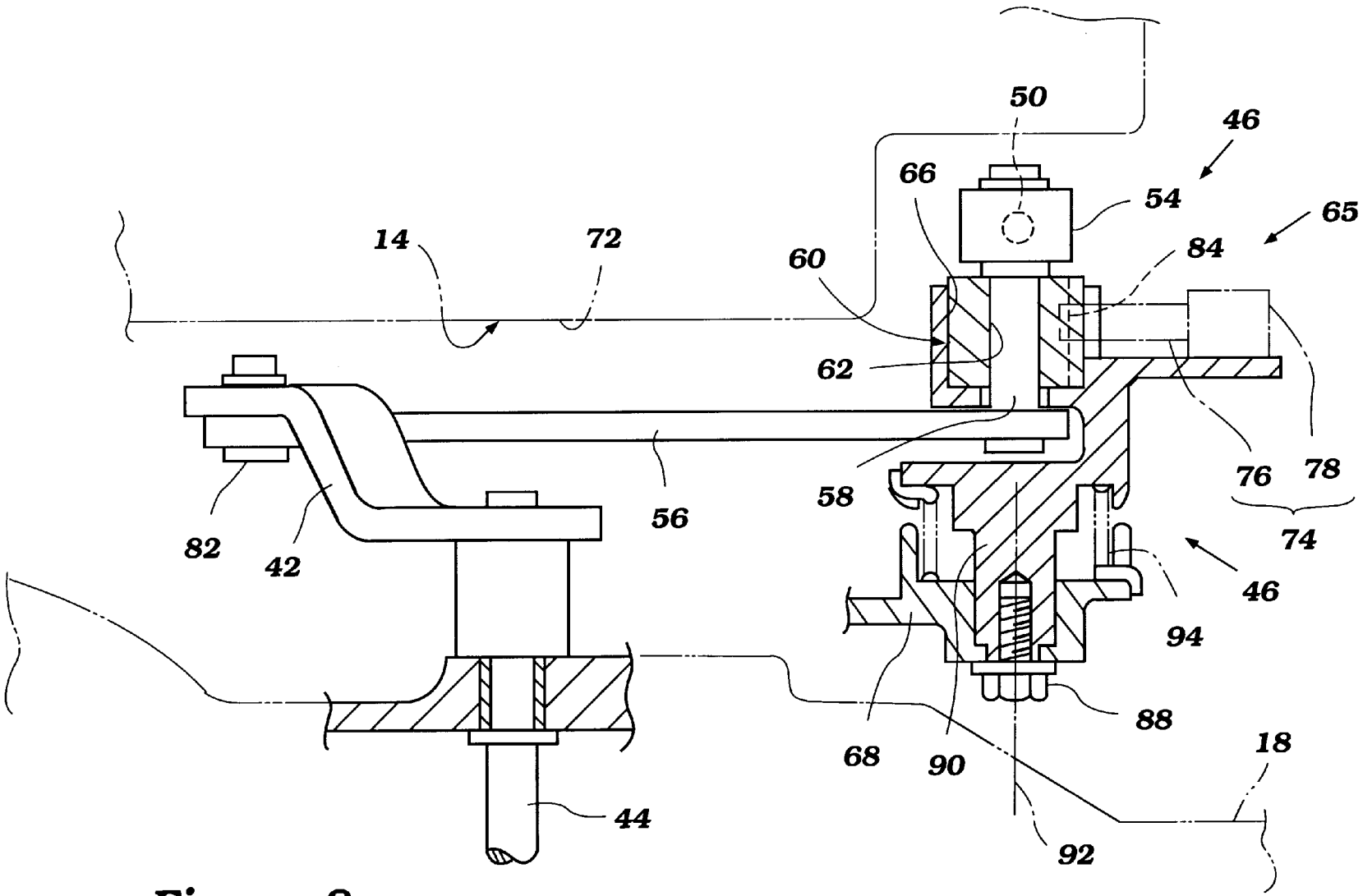
FIG. 8 partially sectioned side elevation view of the shifting mechanism shown in FIG. 7 taken along line 8—8.

As best shown in FIG. 8, the guide mechanism 64 is journalled on a bracket assembly 68 that is affixed to the crank case 72 in a suitable manner, as by bolts 70 (FIG. 7). With reference to FIG. 8, the bracket 70 has a pivot shaft 88. The pivot shaft 88 is preferably threaded into a pivot rod 90 formed in the base of the guide 64. Thus, the guide 64 is journalled for pivotal movement about an axis 92 defined by the pivot shaft 88 and pivot rod 90.

Figure 9:
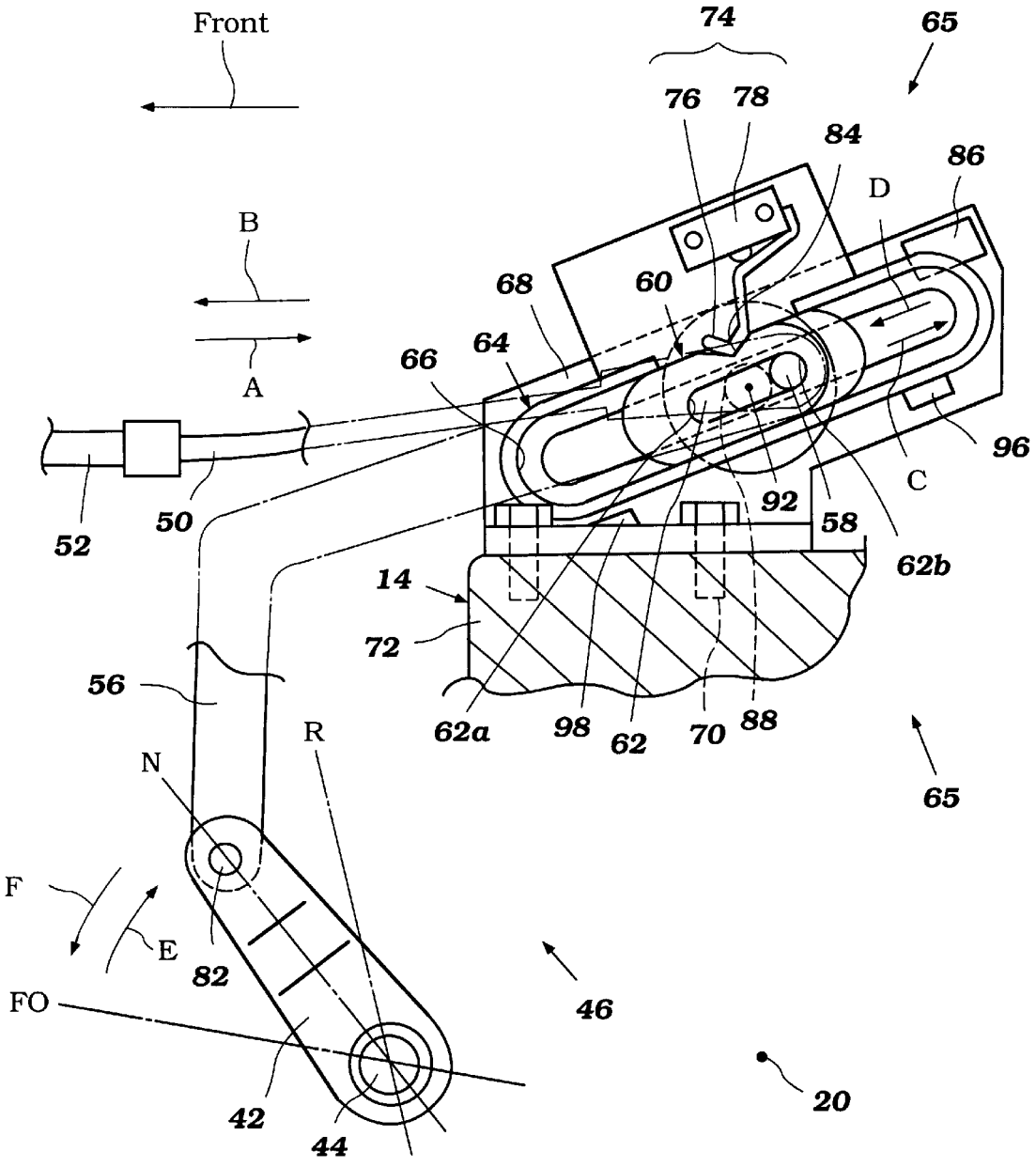
FIG. 9 is a partially sectioned top plan view of the shifting mechanism shown in FIG. 7, with portions removed, and showing the mechanism in a neutral drive position.

A torsional spring 94 encircles the pivot rod 90 and has its ends engaged with the bracket 70 and the guide 64 for urging the guide 64 for rotation about the axis 92 in a clockwise direction into engagement with a fixed stop 96 (FIG. 7) formed on the bracket assembly 58. This is the normal position for the member 47 and corresponds to the neutral position of the shift lever 42 and slider 60 as shown in FIG. 9.

As shown in FIG. 7, when shifting to the neutral position from the forward drive position, the guide 64 will be rotated in a counterclockwise direction and engage a another limit stop 98 also formed on the bracket 58. This movement of the guide 64 is shown by the dashed lines of FIG. 7 that are referenced by the number 87. When this rotation occurs, the pivot detection sensor 86 detects the rotation and sends a signal to the control unit 80 which will cause the slowing of the speed of the associated engine in a known manner such as by effecting misfiring of its spark plug or spark plugs. This type of circuit is well known and any of the known circuits used for this purpose may be employed.

Figure 10:
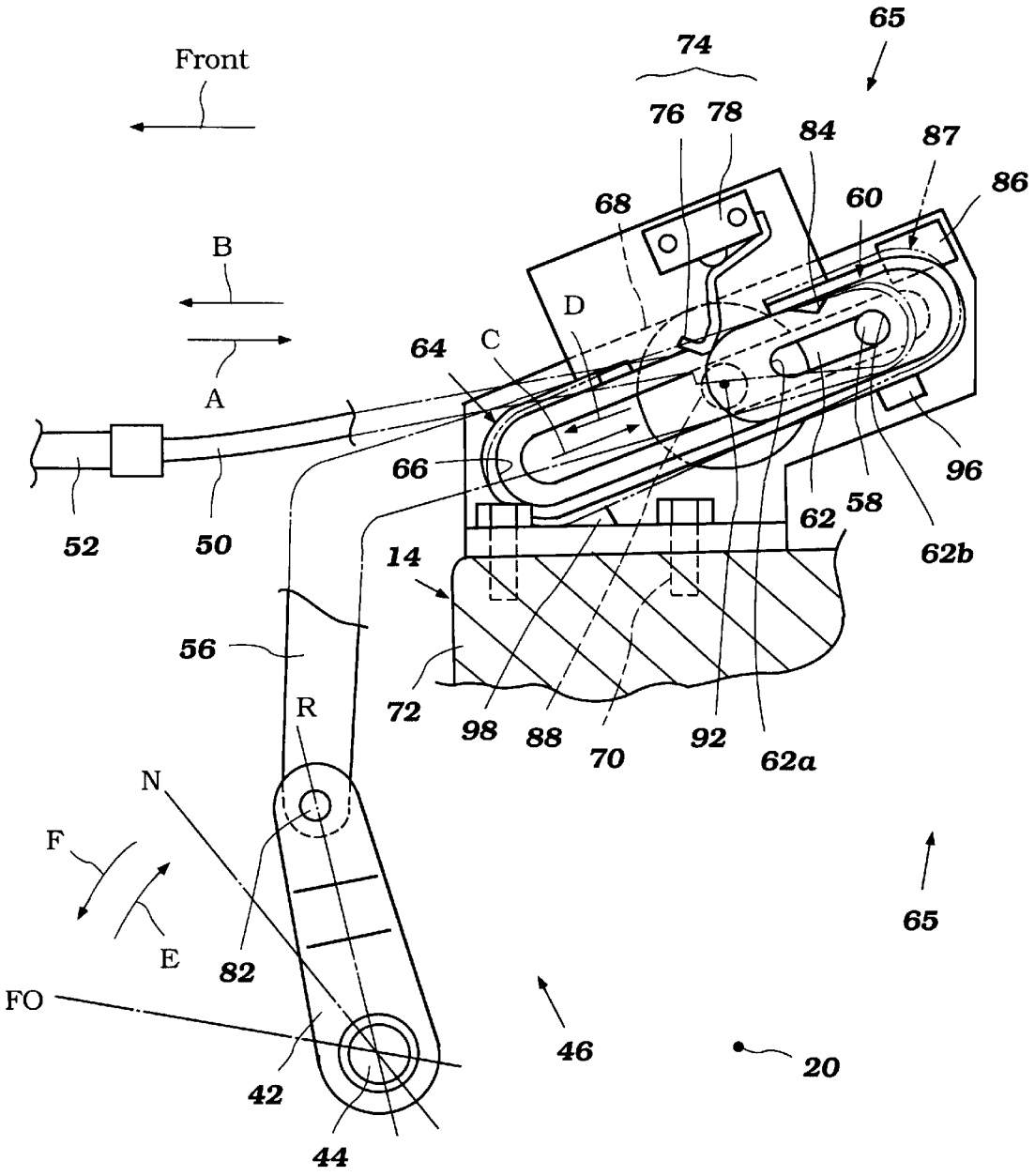
FIG. 10 is a partially sectioned top plan view of the shifting mechanism shown in FIG. 7, with portions removed, and showing the mechanism in a reverse drive position.

Because of the angular inclination of the link 56 and the cooperation of the slider 60 with it, the counterclockwise pivotal movement will be effected regardless of whether the device is being shifted from forward or reverse drive position as may be best seen in FIG. 10. As shown, when the slider 60 is moved in the "D" direction from its reverse position a component force is applied to the guide 64 and the guide 64 pivots from its position illustrated by a solid line to the position illustrated by the dashed line 87. As described above, the pivot detection sensor 86 detects this movement and inputs a signal to the control unit 80, whereby the engine 14 is disabled temporarily.

Figure 11:
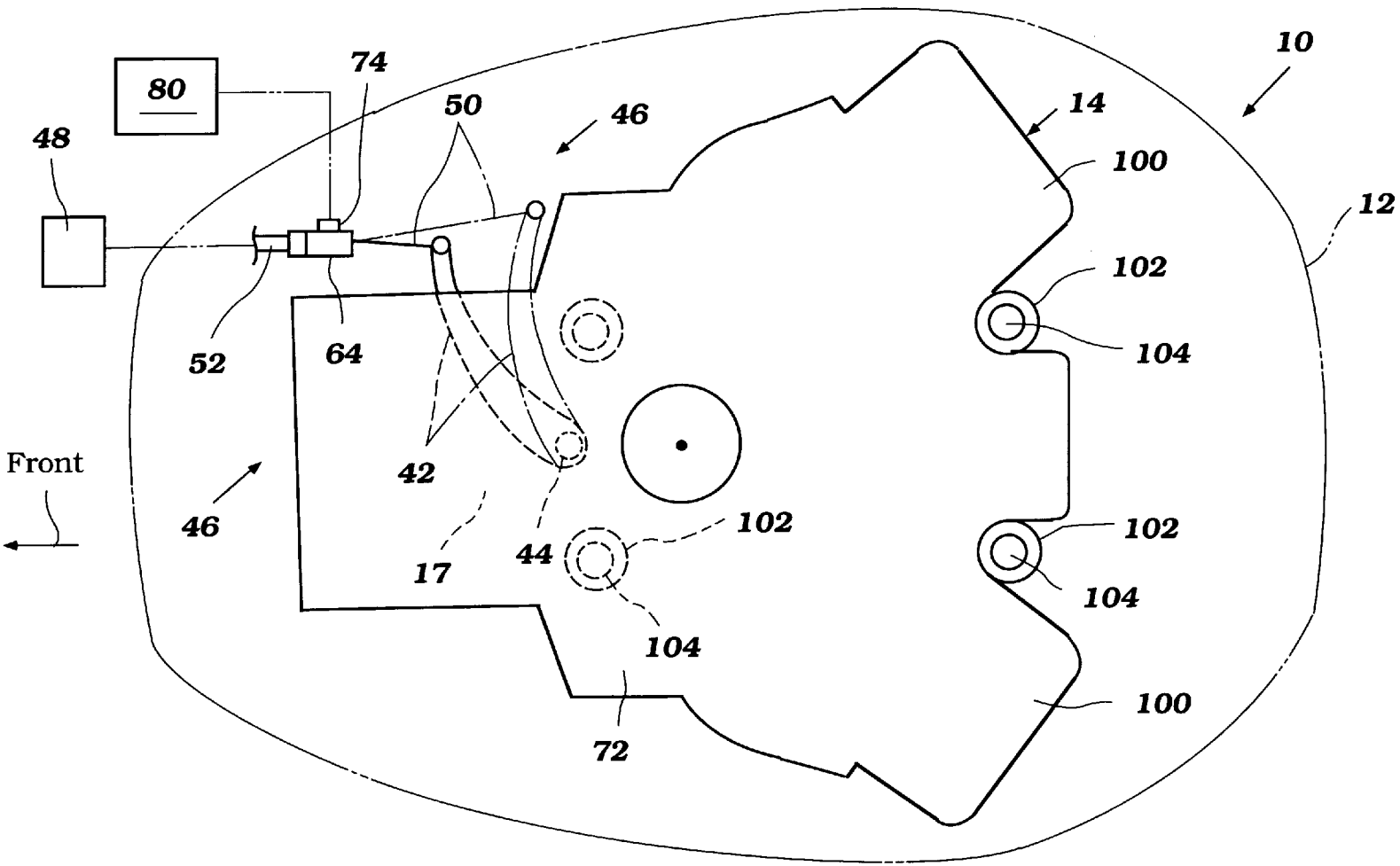
FIG. 11 is a schematic top plan view of the engine with a cowling outline shown in phantom lines and another shifting mechanism configured in accordance with certain features aspects and advantages of the present invention.
Figure 12:
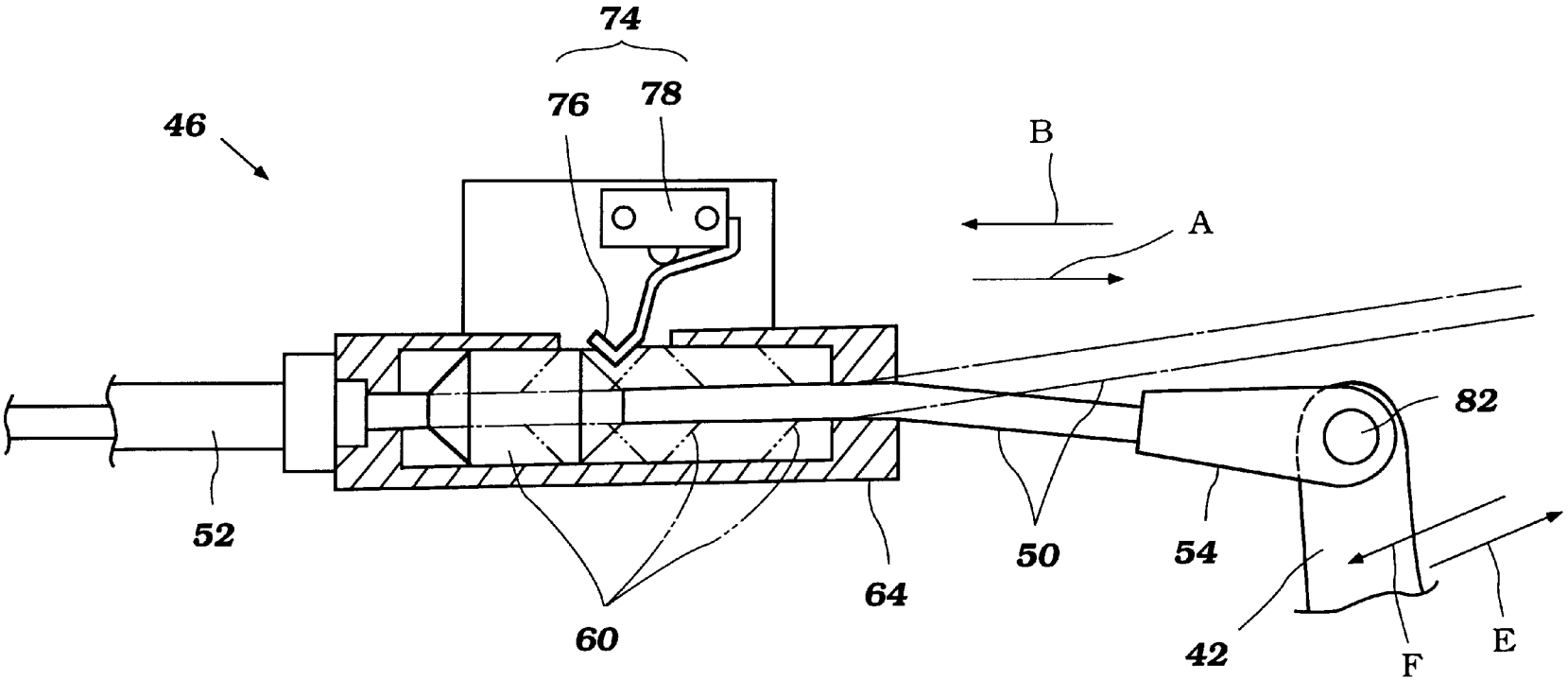
FIG. 12 is a more detailed top plan view of the shifting mechanism shown in FIG. 11.

A third arrangement of the present invention is depicted in FIGS. 11 and 12. Elements of this arrangement that are similar to the other arrangements will be given the same reference numbers. A Bowden-wire-type shift cable 50 desirably couples the operator unit to the shifting mechanism 46. As in the previous arrangements, the cable has an outer casing 52. The cable 50 and the outer casing 52 are fitted to a guide 64. A fitting 54 is positioned at the end of the cable 50 and coupled to an end of a shift control lever 42. A pivot pin 82 of the shift mechanism 46 interconnects the cable fitting 54 and the shift control lever 42 in order to permit relative rotational movement between these components. As best shown in FIG. 11, the shift lever 42 is linked to the shift rod 44 and thus movement of the cable 50 rotates the shift rod 44 and shifts the gear of the transmission 38 as described above.

As shown in FIG. 12, the guide 64 is located on the cable 50 so that the cable 50 slides only in a linear direction. Furthermore, sliders 60 are mounted on the cable 30. The sliders 60 are situated within a groove (not shown) in the guide member 64 so that they slide within the guide 64 in a linear direction.

A shift position detection sensor 74 is located along one side of the guide 64 at a right angle to the sliders 60 and the cable 50. The shift position detection sensor 74 is comprised of a detection lever 76 and a sensor body 78. During operation, the shift position sensor 74 transmits signals to a control unit 80. The function and purpose of the shift position detection sensor 74 is as described above. Furthermore, as with the embodiments described above, the detection lever 76 physically restrains the gliders 60 in a particular position.

As illustrated by the dashed lines in FIG. 12, the sensor 74 detects the motion of the cable in an "A" or "B" direction by sensing the movement of the sliders 60 through the guide 64. As such, the sensor can detect the forward, neutral and reverse positions of the shift lever 42. The guide member 64, sliders 60 and sensor 76 can be located anywhere on the cable 50. This provides flexibility as to the location of the sensor 46. As such, the sensor 46 may be located further to the side of the engine 12 as shown in FIG. 11. Thereby, assembly and maintenance of the sensor 46 is made easier.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. A marine propulsion system comprising a transmission with at least two operating states, a shift mechanism coupled to the transmission to establish the operating state of the transmission, the shift mechanism being movable between at least a first shift position and a second shift position with the first shift position corresponding to the first operating state of the transmission and the second shift position corresponding to the second operating state of the transmission, an operator unit disposed remotely relative to the shift mechanism, the operator unit being adapted to move between at least first and second control positions and being coupled to the shift mechanism such that movement of the operator unit to the first control position positions the shift mechanism in the first shift position, and movement of the operator unit to the second control position positions the shift mechanism in the second shift position, the shift mechanism including a guide defining a substantially linear path and supported to rotate about an axis, a member that moves along the path, a shift position sensor arranged to contact the member so as to detect at least one of the shift positions, and a pivot detection sensor configured to detect rotational movement of the guide.

2. A marine propulsion system as in claim 1, wherein the member comprises a slider that moves relative to the guide of the shift mechanism, the guide being configured to establish the substantially linear path of the slider.

3. A marine propulsion system as in claim 2 wherein the guide is configured to permit rotational movement of the guide when the slider moves linearly relative to the guide.

4. A marine propulsion system comprising a transmission with at least two operating states, a shift mechanism coupled to the transmission to establish the operating state of the transmission, the shift mechanism being movable between at least a first shift position and a second shift position with the first shift position corresponding to the first operating state of the transmission and the second shift position corresponding to the second operating state of the transmission, an operator unit disposed remotely relative to the shift mechanism, the operator unit being adapted to move between at least first and second control positions and being coupled to the shift mechanism such that movement of the operator unit to the first control position positions the shift mechanism in the first shift position, and movement of the operator unit to the second control position positions the shift mechanism in the second shift position, the shift mechanism including a guide configured to establish a substantially linear path, a member that moves along the substantially linear path, and a shift position sensor arranged to cooperate with the member so as to detect at least one of the shift positions, wherein the operator unit is coupled to the shift mechanism in part by a lost motion coupling.

5. A marine propulsion system as in claim 4 additionally comprising a cable link extending between the shift mechanism and the operator unit, and the lost motion coupling connecting the cable link to the member.

6. A marine propulsion system as in claim 5, wherein the member is pivotally coupled to a link of the shift mechanism.

7. A marine propulsion system as in claim 5, wherein the member is coupled to a lever of the shift mechanism by a second cable link.

8. A marine propulsion system comprising a transmission with at least two operating states, a shift mechanism coupled to the transmission to establish the operating state of the transmission, the shift mechanism being movable between at least a first shift position and a second shift position with the first shift position corresponding to the first operating state of the transmission and the second shift position corresponding to the second operating state of the transmission, an operator unit disposed remotely relative to the shift mechanism, the operator unit being adapted to move between at least first and second control positions and being coupled to the shift mechanism such that movement of the operator unit to the first control position positions the shift mechanism in the first shift position, and movement of the operator unit to the second control position positions the shift mechanism in the second shift position, the shift mechanism including a guide configured to establish a substantially linear path, a member that moves along the substantially linear path, and a shift position sensor arranged to cooperate with the member so as to detect at least one of the shift positions, wherein the sensor and (the member include interengaging members that cooperate when the member is in the one shift position to inhibit movement of the member from the one shift position.

9. A marine propulsion system as in claim 1 additionally comprising a control unit coupled to the shift position sensor.

10. A marine propulsion system as in claim 9 additionally comprising an engine, and the control unit communicates with at least one component of the engine.

11. A marine propulsion system as in claim 10, wherein the sensor is located on a side of the engine and to an outer side of the shift mechanism.

12. A marine propulsion system as in claim 10, wherein the engine includes an output shaft that is disposed to rotate about a generally vertical axis.

13. A marine propulsion system as in claim 10, wherein at least one of the operating states of the transmission is a neutral operating state, and the control unit is configured to allow the engine to start only when the shift mechanism is in a shift position that corresponds to the neutral operating state of the transmission.

14. A marine propulsion system as in claim 9, wherein the shift position sensor is configured to output a first signal to the control unit when the shift mechanism is in the one shift position and to output a second signal to the control unit when the shift mechanism is moved from the one shift position.

15. A marine propulsion system comprising an engine, a transmission being coupled to the engine and having at least two operating states, a shift mechanism coupled to the transmission to establish the operating state of the transmission, the shift mechanism being movable between at least a first shift position and a second shift position with the first shift position corresponding to the first operating state of the transmission and the second shift position corresponding to the second operating state of the transmission, an operator unit disposed remotely relative to the shift mechanism, the operator unit being adapted to move between at least first and second control positions and being coupled to the shift mechanism such that movement of the operator unit to the first control position positions the shift mechanism in the first shift position, and movement of the operator unit to the second control position positions the shift mechanism in the second shift position, and a shift position sensor arranged to detect at least one of the shift positions, the shift position sensor being arranged on a side of the engine and to an outer side of the shift mechanism.

16. A marine propulsion system as in claim 15 additionally comprising a control unit being coupled to the sensor and communicating with at least one component of the engine.

17. A marine propulsion system as in claim 16, wherein the sensor is configured to output a first signal to the control unit when the shift mechanism is in the one shift position and to output a second signal to the control unit when the shift mechanism is moved from the one shift position.

18. A marine propulsion system as in claim 16, wherein at least one of the operating states of the transmission is a neutral operating state, and the control unit is configured to allow the engine to start only when the shift mechanism is in a shift position that corresponds to the neutral operating state of the transmission.

19. A marine propulsion system as in claim 15, wherein the engine includes an output shaft that is disposed to rotate about a generally vertical axis.

20. A marine propulsion system as in claim 15, wherein the shift mechanism comprises a slider that moves relative to a guide of the shift mechanism, the guide being configured to establish a substantially linear path for the slider.

21. A marine propulsion system as in claim 20, wherein the operator unit is coupled to the shift mechanism in part by a lost motion coupling.

22. A marine propulsion system as in claim 21 additionally comprising a cable link extending between the shift mechanism and the operator unit, and the lost motion coupling connecting the cable link to the slider.

23. A marine propulsion system as in claim 22, wherein the slider is pivotally coupled to a link of the shift mechanism.

24. A marine propulsion system as in claim 20, wherein the sensor and the slider include interengaging members that cooperate when the slider is in the one shift position to inhibit movement of the slider from the one shift position.

25. A marine propulsion system as in claim 20 additionally comprising a support that supports the guide on a pivot axis so as to permit rotational movement of the guide when the slider moves linearly relative to the guide, and a pivot detection sensor arranged to detect such rotational movement of the guide.

26. A marine propulsion system comprising a transmission with at least two operating states, a shift mechanism coupled to the transmission to establish the operating state of the transmission, the shift mechanism being movable between at least a first shift position and a second shift position with the first shift position corresponding to the first operating state of the transmission and the second shift position corresponding to the second operating state of the transmission, an operator unit disposed remotely relative to the shift mechanism, the operator unit being adapted to move between at least first and second control positions and being coupled to the shift mechanism such that movement of the operator unit to the first control position positions the shift mechanism in the first shift position, and movement of the operator unit to the second control position positions the shift mechanism in the second shift position, the shift mechanism including a member that moves along a linear path, and a shift position sensor arranged to cooperate with the member so as to detect and emit a signal when the shift mechanism is moved into at least one of the shift positions and when the shift mechanism is moved from that shift position, a shift assist sensor configured to emit a signal while the shift mechanism is moved between shift positions, and a bracket supporting both the member and the shift position sensor.

27. A marine propulsion system as in claim 26 additionally comprising a control unit coupled to the shift position sensor.

28. A marine propulsion system as in claim 27 additionally comprising an engine, and the control unit communicates with at least one component of the engine.

29. A marine propulsion system as in claim 28, wherein the shift position sensor is located on a side of the engine and to an outer side of the shift mechanism.

30. A marine propulsion system as in claim 28, wherein the engine includes an output shaft that is disposed to rotate about a generally vertical axis.

31. A marine propulsion system as in claim 28, wherein at least one of the operating states of the transmission is a neutral operating state, and the control unit is configured to allow the engine to start only when the shift mechanism is in a shift position that corresponds to the neutral operating state of the transmission.

32. A marine propulsion system as in claim 28, wherein control unit is configured to reduce the speed of the engine when the shift mechanism is moved from at least one shift position.

33. A marine propulsion system comprising a transmission with at least two operating states, a shift mechanism coupled to the transmission to establish the operating state of the transmission, the shift mechanism being movable between at least a first shift position and a second shift position with the first shift position corresponding to the first operating state of the transmission and the second shift position corresponding to the second operating state of the transmission, an operator unit disposed remotely relative to the shift mechanism, the operator unit being adapted to move between at least first and second control positions and being coupled to the shift mechanism such that movement of the operator unit to the first control position positions the shift mechanism in a forward shift position, and movement of the operator unit to the second control position positions the shift mechanism in a reverse shift position, the shift mechanism including a member that moves along a linear path, a first sensing means for detecting when the shift mechanism is in each of the shift positions, a second sensing means for detecting when the shift mechanism is being moved out of the shift positions, and a bracket supporting both of the sensing means.

34. A marine propulsion unit as in claim 33 additionally comprising an engine coupled to the transmission, and the first sensing means being disposed on a side of the engine and to an outer side of the shift mechanism.

35. A marine propulsion unit as in claim 33, wherein the shift mechanism comprises a slider and a guide, and the first sensor means cooperates with the slider.

36. A marine propulsion unit as in claim 35, wherein the slider is pivotally connected to a link of the shifting mechanism.

37. A marine propulsion unit as in claim 35, wherein the slider is connected to a first cable link and a second cable link, the first cable link being coupled to the operator unit, and the second cable link being coupled to a lever of the shift mechanism.

38. A marine propulsion system as in claim 26, wherein the bracket pivotally supports a guide which defines the linear path, the bracket supporting the member via the guide.

39. A marine propulsion system as in claim 33, wherein the bracket pivotally supports a guide which defines the linear path, the bracket supporting the member via the guide.

40. A marine propulsion system as in claim 1 additionally comprising a detection lever connected to the shift position sensor, the shift position sensor contacting the member via physical engagement of the detection lever with the member.

* * * * *